US007726635B2

(12) United States Patent
Heard

(10) Patent No.: US 7,726,635 B2
(45) Date of Patent: Jun. 1, 2010

(54) CLIP FOR ATTACHING A SUPPORT MEMBER ONTO A STEEL FENCEPOST

(76) Inventor: David Gilbert Heard, 691-525 Tara Way, Susanville, CA (US) 96130

( * ) Notice: Subject to any disclaimer, the term of this patent is extended or adjusted under 35 U.S.C. 154(b) by 123 days.

(21) Appl. No.: 12/070,805

(22) Filed: Feb. 20, 2008

(65) Prior Publication Data

US 2009/0206311 A1 Aug. 20, 2009

(51) Int. Cl.
*E04H 17/02* (2006.01)

(52) U.S. Cl. ..... 256/48; 256/65.03; 256/71

(58) Field of Classification Search ..... 264/48, 264/64, 65.02, 65.03, 71; 403/396, 398–400
See application file for complete search history.

(56) References Cited

U.S. PATENT DOCUMENTS

| | | | | | |
|---|---|---|---|---|---|
| 549,192 | A | * | 11/1895 | Garbesi | 403/396 |
| 837,383 | A | * | 12/1906 | Carlton | |
| 1,986,528 | A | * | 1/1935 | Ranger | 403/400 |
| 3,688,937 | A | * | 9/1972 | Ellison | |
| 4,110,951 | A | * | 9/1978 | Padrun | 403/399 |
| 6,050,549 | A | * | 4/2000 | Foy | 256/48 |
| 6,224,433 | B1 | * | 5/2001 | Chadbourne et al. | |
| 6,247,871 | B1 | * | 6/2001 | Nickel et al. | 403/396 |
| 6,499,514 | B1 | * | 12/2002 | Hodge, Sr. | 256/57 |
| 6,883,785 | B1 | * | 4/2005 | Knapp | 256/1 |

* cited by examiner

*Primary Examiner*—Victor MacArthur

(57) ABSTRACT

An attachment clip used in combination with a steel fence post for affixing a horizontal support member thereto. The clip, the steel fence post and the horizontal support member when combined provide additional stability and reduce tilting and settling thereof. This in turn facilitates to maintain the overall height and alignment of the fence line. The clip is a unitary member having a rear elongated gripping channel, an elongated vertical centralized trough, upper and lower attachment flanges and clearance slots.

2 Claims, 3 Drawing Sheets

CLIP FOR ATTACHING A SUPPORT MEMBER ONTO A STEEL FENCEPOST

FIELD OF THE INVENTION

This invention relates in general to a technique for increasing the strength stability, durability and overall performance of wire fences crossing soft soils or wetlands where settling or leaning of steel fence posts may occur. However more particularly the invention pertains to a novel clip used for attaching a horizontal support member onto a vertical steel fencepost. The clip is simply formed from one unitary member and the technique includes easy assembly and installation.

BACKGROUND OF THE PRIOR ART

It is well known within the trade of wire fence installation and\or repair that steel fence posts have a tendency to settle and tilt over time especially when installed in soft soils or wetlands. This settling and tilting causes the wire fence to lean and lower in height at various locations along the fence line, thus greatly reducing the effectiveness of the fence. Attempts to resolve this problem have been made within the art but heretofore have proven to be much too costly and generally ineffective. For example, the prior art requires the addition of numerous costly components such as steel posts, wood posts, or "figure fours" as well as additional wire and/or extra fasteners, etc. and these repairs might also fail at a later date. More importantly this results in significantly increased expense, time and manual labour, which the use of the present invention would eliminate.

OBJECTS AND ADVANTAGES OF THE PRESENT INVENTION

It is therefore a primary object of the present invention to provide a new and novel attachment clip for a support member that is fast and easy to install, universal, functional and adjustably attachable onto any steel fence post.

Also another object of the present invention is to provide an attachment clip that can be manufactured from any suitable stock flat material of engineering choice, such as sheet metal, steel, aluminium or the like. After the attachment clip has been stamped and cut it is then easily bent and shaped accordingly.

Another important object of the present invention is to provide an attachment clip that can be moulded to conform and grasp a piece of steel fence post as well as more than one other type of horizontal support member of choice, such as, angle iron, flat iron, round stock, etc.

Yet a further object of the present invention is to provide a fence post support system wherein the combination of the attachment clip, the vertical steel post, and the horizontal support member when positioned at ground level, reduces detrimental settling and tilting of the vertical steel post, therefore, greatly maintaining the overall height and alignment of the fence line, especially in soft soils or wetlands.

Also another object of the present invention is to provide a fence post support system wherein the horizontal support member if needed can rest on top of a larger base, such as a steel plate or rocks for increased strength and stability.

A further object of the present invention is to provide an attachment clip and fence post support system that does not require any specialized tools other than those commonly associated and typically used during normal fence installation and/or repair.

Still a further object of the present invention is to provide an attachment clip and fence post support system that requires a minimal amount of additional expense, time and manual labour.

Yet a further object of the present invention is to provide an attachment clip and fence post support system that can be used easily not only during new construction, but also during repair and maintenance operations utilizing a post puller where settling has already occurred.

Also a further object of the present invention is to provide an attachment clip and fence post support system that can be removed easily when abandoning or moving a fence line and reused at another location if required.

A most important object of the present invention is to provide an attachment clip and fence post support system that recognizes, addresses, and resolves problematic fence stability in a manner heretofore not available or taught.

BRIEF DESCRIPTION OF DRAWINGS

FIG. (1-A) is a perspective right frontal view of the attachment clip when uninstalled.

FIG. (1-B) is a perspective right rear view of the attachment clip when uninstalled.

Figure 1A:
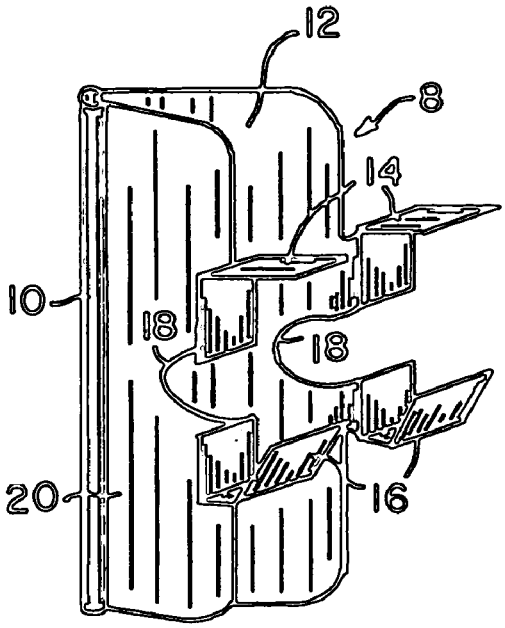
Figure 1B:
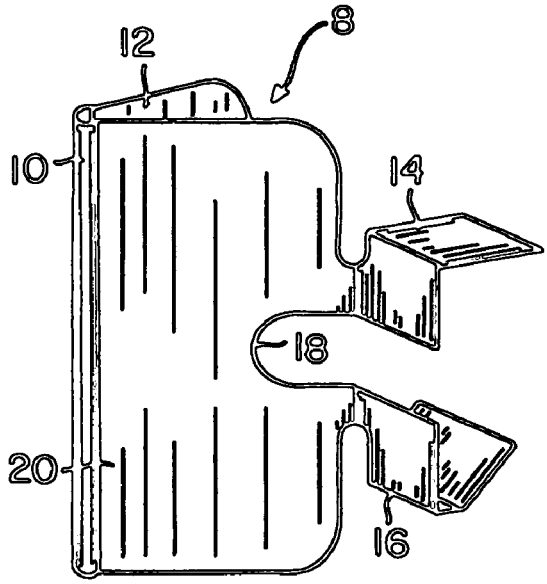

REFERENCE NUMBERS IN DRAWINGS (8) Integrally formed unitary attachment clip
(10) Rear elongated gripping channel
(12) Elongated vertical centralized trough
(14) A pair of outwardly protruding horizontal upper bendable attachment flanges
(16) A pair of outwardly and upwardly protruding horizontal bendable lower attachment flanges
(18) Clearance slots
(20) Unitary formed body member
(22) Horizontal support member
(24) A piece of pre-existing standard steel fence post
(24-*a*) Horizontal spine
(24-*b*) Upwardly protruding vertical short leg
(24-*c*) Downwardly protruding vertical short leg
(25) Horizontal ears
(26) Fence post blade (embedded to proper depth in earth)
(27) Standard full sized steel fence post
(27-*a*) Vertical spine
(27-*b*) Left hand short leg
(27-*c*) Right hand short leg
(28) Undisturbed earth
(29) Vertical ears

DETAILED DESCRIPTION OF THE DRAWINGS

Referring now in detail to the drawings wherein like characters refer to like elements throughout the various views as follows: The present invention is substantially an improved technique for improving the stability of a steel fence post so as to reduce settling and tilting thereof. The improved technique including in combination of a novel attachment clip (8), a vertical steel fence post (27) and a horizontal support member (22) of which in the preferred embodiment is a piece of standard steel fence post (24).

As depicted throughout the views, the attachment clip (8) is of simple construction and can be easily stamped and cut from any standard flat stock material. Therefore providing an integrally formed unitary attachment clip (8). It is to be understood any suitable stock material of engineering choice may be used. For example, but not limited to sheet metal, steel, aluminum, etc. Furthermore, the attachment clip (8) as depicted herein is only exemplary of one possible configuration as numerous shapes and sizes are inherent. Still further the horizontal support member (22), as depicted herein is only exemplary as it also may be of various materials, including but not limited to a piece of fence post, angle iron, flat iron, round stock, etc. A piece of steel fence post (24) is the preferred horizontal support member and will be used in the drawings 2 & 3 and subsequent descriptions.

Within each of the views (8) represents an overview of the preferred embodiment for the attachment clip (8) of the present invention which is stamped, cut and bent from one flat piece of sheet metal or the like. In general, the present attachment clip (8) comprises a unitary formed body member (20) which when shaped forms a rear elongated gripping channel (10), an elongated vertical centralized trough (12), a pair of outwardly protruding horizontal upper bendable attachment flanges (14), a pair of outwardly and upwardly protruding horizontal lower bendable attachment flanges (16) and clearance slots (18).

Figure 2:
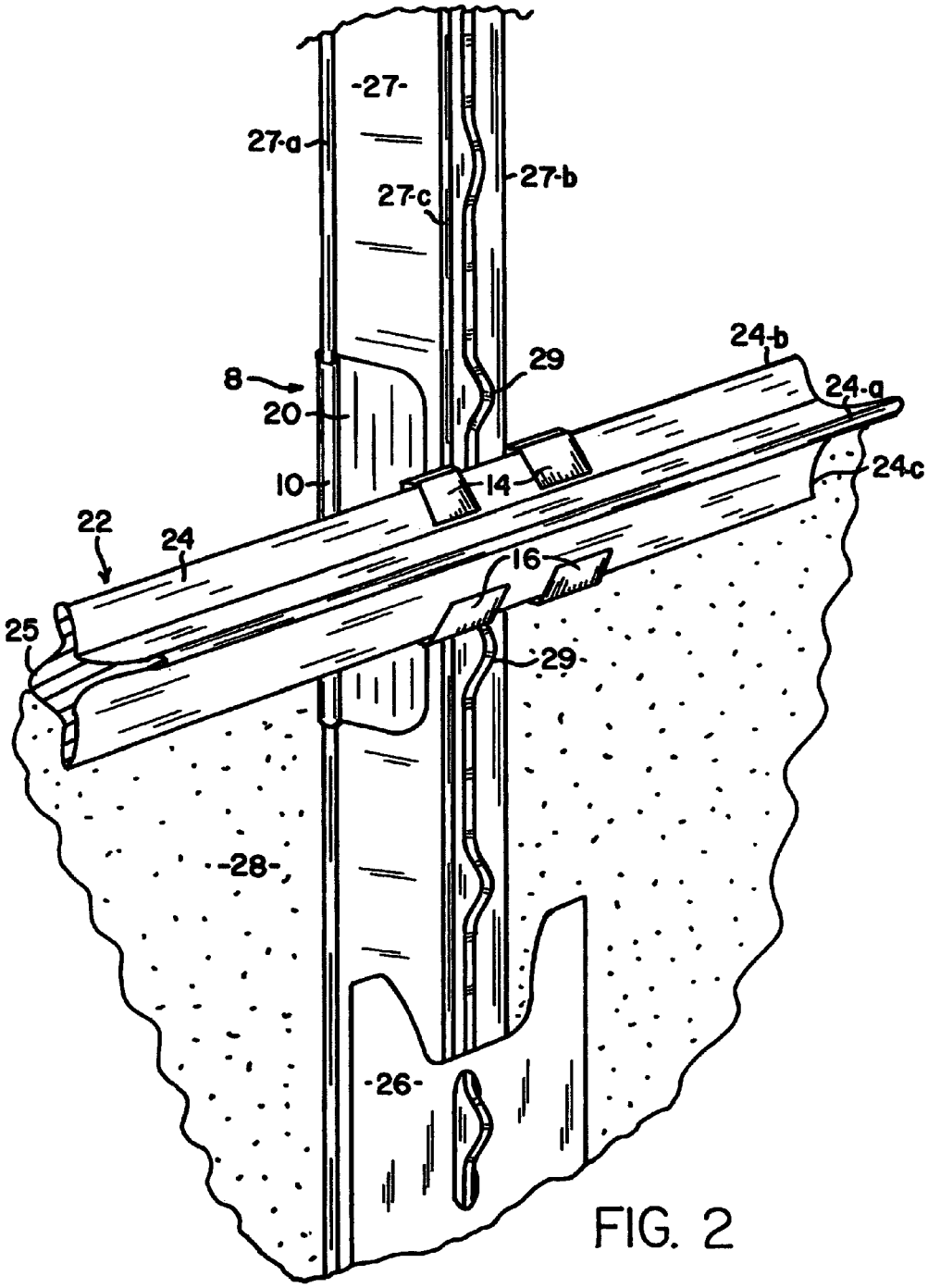
FIG. 2 is a perspective frontal plan view of the attachment clip when installed at ground level onto a vertical steel fence post and attached onto a horizontal support member.
Figure 3:
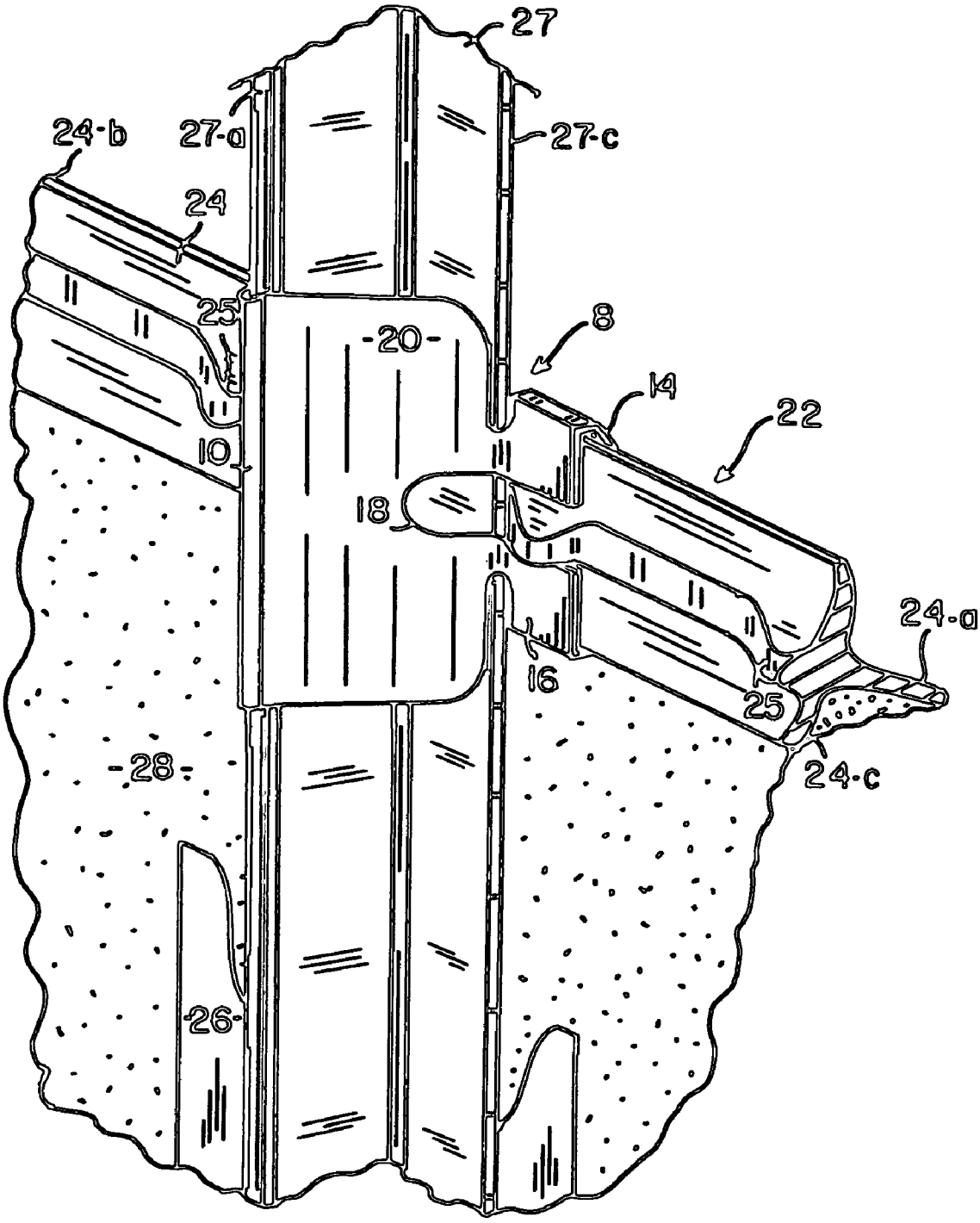
FIG. 3 is a perspective rear view of the attachment clip when installed at ground level onto a vertical steel fence post and attached onto a horizontal support member.

Referring now to FIGS. 2 & 3 which depict a plan view of the present invention when assembled and properly installed. As clearly illustrated in FIG. 2, the preferred embodiment for the horizontal support member (22) is a piece of pre-existing standard steel fence post (24). When installed, the piece of pre-existing steel fence post (24) is substantially in the shape of an elongated sideways backward tilted (T) having one outwardly protruding horizontal spine (24-*a*), an upwardly protruding vertical short leg (24-*b*) and a downwardly protruding vertical short leg (24-*c*). Furthermore as can be seen in FIGS. 2 & 3, the piece of pre-existing standard steel fence post (24) also has outwardly extending equally spaced apart horizontal ears (25).

As further illustrated, the preferred standard full sized steel fence post (27) when installed is substantially in the shape of an elongated sideways forward tilted (T) having one outwardly protruding vertical spine (27-*a*), a left hand outwardly protruding horizontal short leg (27-*b*) and a right hand outwardly protruding horizontal short leg (27-*c*). Additionally as depicted in FIGS. 2 & 3, the pre-existing standard steel fence post (27) also has outwardly extending equally spaced apart vertical ears (29).

Thus it can now be seen that when the attachment clip (8) is installed onto the standard steel fence post (27), the rear elongated vertical gripping channel (10) has a mating relationship with the exterior edge of the outwardly protruding vertical spine (27-*a*). The central section of the outwardly protruding vertical spine (27-*a*) is positioned within the elongated vertical centralized trough (12), and the clearance slots (18) are centered between two vertical ears (29). The downwardly protruding vertical short leg (24-*c*) of the horizontal support member (24), is positioned upon the pair of outwardly and upwardly protruding horizontal lower bendable attachment flanges (16), the horizontal ears (25) are aligned with the clearance slots, and the upwardly protruding vertical short leg (24-*b*) is positioned underneath the pair of outwardly protruding horizontal upper bendable attachment flanges (14).

It is to be understood during installation the workman firstly positions the outwardly protruding vertical spine (27-*a*) into the rear elongated vertical gripping channel (10). Secondly, the workman aligns the outwardly extending equally spaced apart horizontal ears (25) within the clearance slots (18), respectively, while aligning the clearance slots (18) between two vertical ears (29) and simultaneously inserting the downwardly protruding vertical short leg (24-*c*) into proper position on top of the pair of outwardly and upwardly protruding horizontal lower bendable attachment flanges (16) which in turn automatically positions the upwardly protruding vertical short leg (24-*b*) underneath the pair of outwardly protruding horizontal upper bendable attachment flanges (14). Thirdly, the workman manually bends the pair of outwardly protruding horizontal upper bendable attachment flanges (14) downwardly until the piece of pre-existing standard steel fence post (24) is securely affixed in place. Finally, the workman simply drives the standard steel fence post (27) into the earth (28) until the horizontal support member (22) is firmly positioned at ground level above earth (28), the fence post blade (26) is embedded to the proper depth, and the installation is complete.

It can now be seen herein is a horizontal support member made from readily available materials either new or recycled to be attached onto a steel fence post in combination with a novel and unique attachment clip. The invention is easily manufactured, is simple to assemble, easy to install, and is most cost effective to buy and use.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. In combination a clip; a support member; and a steel fence post; said clip comprising; a unitary body member which forms an elongated gripping channel; an elongated vertical centralized trough; a pair of protruding upper bendable attachment flanges; a pair of protruding lower bendable attachment flanges; and clearance slots; said clip being adjustably attachable onto said steel fence post, said pair of upper bendable attachment flanges with said pair of protruding lower bendable attachment flanges in combination fixedly support and retain said support member therebetween, said steel fence post is an elongated sideways forward tilted (T) having one outwardly protruding vertical spine; a left hand outwardly protruding horizontal short leg; a right hand outwardly protruding horizontal short leg; and outwardly extending equally spaced apart vertical ears; said horizontal support member is a piece of a pre-existing steel fence post, said piece of pre-existing steel fence post is an elongated sideways backward tilted (T) having one outwardly protruding horizontal spine; an upwardly protruding vertical short leg; a downwardly protruding vertical short leg and outwardly extending equally spaced apart horizontal ears, said rear elongated vertical gripping channel has a mating relationship with an exterior edge of said outwardly protruding vertical spine of said steel fence post, a central section of said outwardly protruding vertical spine of said steel fence post is positioned within said elongated vertical centralized trough, said clearance slots are aligned mid-way between any two said vertical ears of said steel fence post, said downwardly protruding vertical short leg of support member is positioned upon said pair of outwardly and upwardly protruding horizontal lower bendable attachment flanges, said horizontal ears are aligned and engaging within said clearance slots, said upwardly protruding vertical short leg of support member is positioned underneath said pair of outwardly protruding horizontal upper bendable attachment flanges, which are then bent to engage said upper vertical short leg of said support member.

2. The combination clip, support member and steel fence post of claim 1 wherein said clip is stamped and cut from flat stock material.

* * * * *